US012768178B2

(12) United States Patent
Gray et al.

(10) Patent No.: US 12,768,178 B2
(45) Date of Patent: Oct. 20, 2026

(54) CORNER CASTING AND RELATED SYSTEMS AND METHODS FOR USE IN FORMWORK

(71) Applicant: Wilian Holding Co., Des Moines, IA (US)

(72) Inventors: Andrew Gray, Ankeny, IA (US); Adam Bauer, Des Moines, IA (US)

(73) Assignee: Wilian Holding Co., Des Moines, IA (US)

( * ) Notice: Subject to any disclaimer, the term of this patent is extended or adjusted under 35 U.S.C. 154(b) by 107 days.

(21) Appl. No.: 18/434,564

(22) Filed: Feb. 6, 2024

(65) Prior Publication Data

US 2024/0263464 A1 Aug. 8, 2024

Related U.S. Application Data

(60) Provisional application No. 63/443,630, filed on Feb. 6, 2023.

(51) Int. Cl.
*E04G 9/06* (2006.01)
*E04G 17/00* (2006.01)

(52) U.S. Cl.
CPC ..... *E04G 9/06* (2013.01); *E04G 17/001* (2013.01)

(58) Field of Classification Search
CPC ..... E04G 9/06; E04G 17/001; E04G 11/08; E04B 2002/867; E04B 1/3483; E04B 1/34326; B28B 7/0014
See application file for complete search history.

(56) References Cited

U.S. PATENT DOCUMENTS 946,423 A * 1/1910 Connaty ..... E04B 1/2403 403/217
4,267,682 A * 5/1981 Fowler ..... E04B 1/08 403/231
4,691,970 A * 9/1987 Neri ..... H05K 7/183 312/265.5
5,605,410 A * 2/1997 Pantev ..... F16B 7/0486 403/174
6,974,276 B2 * 12/2005 Kirchner ..... F16B 7/0486 248/62
8,950,817 B2 * 2/2015 Lacovoni ..... A47B 13/021 297/135
9,549,482 B2 * 1/2017 Podemski ..... H05K 7/02
10,472,823 B2 11/2019 Chevis
10,870,980 B2 * 12/2020 Bowron ..... E04B 1/3483
(Continued)

*Primary Examiner* — Gisele D Ford
(74) *Attorney, Agent, or Firm* — Dentons Davis Brown; Kassandra Rittmer; Matthew Warner-Blankenship

(57) ABSTRACT

A formwork panel system comprising corner connectors comprising a first body portion and a second body portion forming a 90° angle, at least one opening in the first body portion, a first prong extending from the first body portion, and a second prong extending from the second body portion, wherein the corner connectors and side rails form a rigid body connected to a first panel. The panel system where the at least one opening secures the corner connector to a corner connector of a second panel via a bolt and rectangular nut member. The panel system further comprising plurality of fasteners configured to be inserted into prong openings wherein the plurality of fasteners are configured to compress the side rails about the prongs.

16 Claims, 17 Drawing Sheets

(56) References Cited

U.S. PATENT DOCUMENTS

| | | | | |
|---|---|---|---|---|
| 11,732,459 | B2 * | 8/2023 | Bowron | E04B 1/3483 52/655.1 |
| 2001/0037988 | A1 * | 11/2001 | Knab | H02B 1/01 211/189 |
| 2004/0001739 | A1 * | 1/2004 | Kirchner | A47B 57/54 403/382 |
| 2013/0306808 | A1 * | 11/2013 | Huang | A47B 13/06 248/163.1 |
| 2016/0002909 | A1 * | 1/2016 | Bowron | E04B 1/3483 52/745.03 |
| 2016/0073526 | A1 * | 3/2016 | Chen | F16B 12/46 312/283 |
| 2017/0362811 | A1 * | 12/2017 | King, Jr. | F16B 12/40 |
| 2019/0078321 | A1 * | 3/2019 | Bowron | E04H 1/005 |
| 2020/0080302 | A1 | 3/2020 | Chevis | |
| 2020/0199870 | A1 | 6/2020 | Chevis | |
| 2022/0349195 | A1 * | 11/2022 | Rogers | E04H 1/1205 |

* cited by examiner

DETAIL 1
(KEY HOLE)

CORNER CASTING AND RELATED SYSTEMS AND METHODS FOR USE IN FORMWORK

CROSS-REFERENCE TO RELATED APPLICATION(S)

This application claims the benefit under 35 U.S.C. § 119(e) to U.S. Provisional Application 63/443,630, filed Feb. 6, 2023, and entitled CORNER ASSEMBLY FOR USE IN FORMWORK, which is hereby incorporated herein by reference in its entirety for all purposes.

TECHNICAL FIELD

The disclosure relates to various devices, systems, and method of use thereof for assembling and connecting formwork panels.

BACKGROUND

As would be generally understood, when two independent parts are joined together they must be the same material in order to be welded together or dissimilar materials may be fastened or adhered to create an assembly. Clearance is required for fastener installation and this required clearance allows for joint rotation prior to the fasteners coming into an interference condition. Joint rotation is detrimental to the rigidity and squareness of the assembly.

It would be understood that many known formwork panel systems are welded together. Certain known fastened formwork systems use screws with nylon patches to prevent loosening upon screw installation.

Various known formwork assemblies use a multitude of fasteners and require specialty components for creation of a stable assembly. For example, with prior known formwork panel designs connections between panels require supplemental parts and pieces (often known as compensation walers) that are added to the formwork to maintain alignment of panels and to allow panels to be picked up from one end when laying flat on the forming face. These additional parts and pieces add to the expense of the formwork system, are additional items that must be installed, and are often an additional obstruction to work around when using the formwork system.

BRIEF SUMMARY

Disclosed herein are various devices, systems, and methods for constructing a formwork panel and joining various panels together. Described herein is a corner element configured to be joined with one or more side panels via prongs, locking grooves, and/or fasteners. The corner elements may be further configured to be joined to each other and thereby join multiple panel assemblies together to create a larger formwork assembly.

In Example 1, a formwork connector comprising a body comprising a first portion and a second portion forming a 90° angle a first opening in the first portion of the body configured for attaching the formwork connector to another formwork connector, and a first prong extending from the first portion configured to engage a side rail.

Example 2 relates to the formwork connector of any of Examples 1 and 3-6, further comprising a first prong opening disposed through the first prong.

Example 3 relates to the formwork connector of any of Examples 1-2 and 4-6, further comprising a first fastener configured to be inserted into the first prong opening, wherein the first fastener is a lockbolt.

Example 4 relates to the formwork connector of any of Examples 1-3 and 5-6, wherein the first fastener is configured to compress the side rail about the first prong.

Example 5 relates to the formwork connector of any of Examples 1-4 and 6, further comprising a second prong extending from the first portion and a second fastener configured to be inserted into a second prong opening to compress the side rail about the second prong Example 6 relates to the formwork connector of any of Examples 1-6, wherein the body is comprised of zinc alloy and the side rail is comprises of aluminum.

In Example 7, a formwork panel system comprising a panel, a first side rail and a second side rail connected to the first panel, and a corner connector connecting the first side rail to the second side rail. The corner connector comprising a body comprising a first portion and a second portion forming a 90° angle, at least one opening in the first portion, a first prong extending from the first portion, and a second prong extending from the second portion, wherein the first side rail is engaged with the first prong and the second side rail is engaged with the second prong via lockbolts.

Example 8 relates to the formwork panel system of any of Examples 7 and 9-12, wherein the first prong comprises one or more faces comprising a plurality of locking grooves and the second prong comprises one or more faces comprising a plurality of locking grooves.

Example 9 relates to the formwork panel system of any of Examples 7-8 and 10-12, wherein the lockbolts are configured to compress the first and second side rail about the first and second prong, respectively.

Example 10 relates to the formwork panel system of any of Examples 7-9 and 11-12, further comprises a rectangular nut member configured to accept a bolt inserted through the at least one opening.

Example 11 relates to the formwork panel system of any of Examples 7-10 and 12, wherein the corner connector is comprised of a first material, the first side rail and second side rail are comprised of a second, and the lockbolts are comprised of a third.

Example 12 relates to the formwork panel system of any of Examples 7-11, wherein the corner connector is comprised of a zinc alloy, the first side rail and second side rail are comprised of aluminum, and the lockbolts are comprised of steel.

In Example 13 a formwork panel system comprising a first panel, a plurality of side rails disposed about the first panel, and a plurality of corner connectors connecting the plurality of side rails into a closed shape. Each corner connector comprising a body comprising a first portion and a second portion forming a 90° angle, at least one opening in the first portion, a first prong extending from the first portion, and a second prong extending from the second portion, wherein the plurality of corner connectors and plurality of side rails form a rigid body secured to the first panel.

Example 14 relates to the formwork panel system of any of Examples 13 and 15-20, wherein the at least one opening secures the panel to a second panel having a corner connector via a bolt and rectangular nut member.

Example 15 relates to the formwork panel system of any of Examples 13-14 and 16-20, further comprising at least one prong opening in the first prong and at least one prong opening in the second prong.

Example 16 relates to the formwork panel system of any of Examples 13-15 and 17-20, further comprising plurality of fasteners configured to be inserted into each of the at least one prong openings wherein the plurality of fasteners are configured to compress the side rails about the prongs.

Example 17 relates to the formwork panel system of any of Examples 13-16 and 18-20, wherein the at least one fastener is a direct tension lockbolt.

Example 18 relates to the formwork panel system of any of Examples 13-17 and 19-20, wherein the plurality of corner connectors are comprised of a zinc alloy.

Example 19 relates to the formwork panel system of any of Examples 13-18 and 20, wherein panels are configured to be stacked without the use of wailings.

Example 20 relates to the formwork panel system of any of Examples 13-19, wherein the panel is configured to be assembled with less than eighty fastening items. While multiple embodiments are disclosed, still other embodiments of the disclosure will become apparent to those skilled in the art from the following detailed description, which shows and describes illustrative embodiments of the invention. As will be realized, the disclosure is capable of modifications in various obvious aspects, all without departing from the spirit and scope of the disclosure. Accordingly, the drawings and detailed description are to be regarded as illustrative in nature and not restrictive.

DETAILED DESCRIPTION

Figure 1:
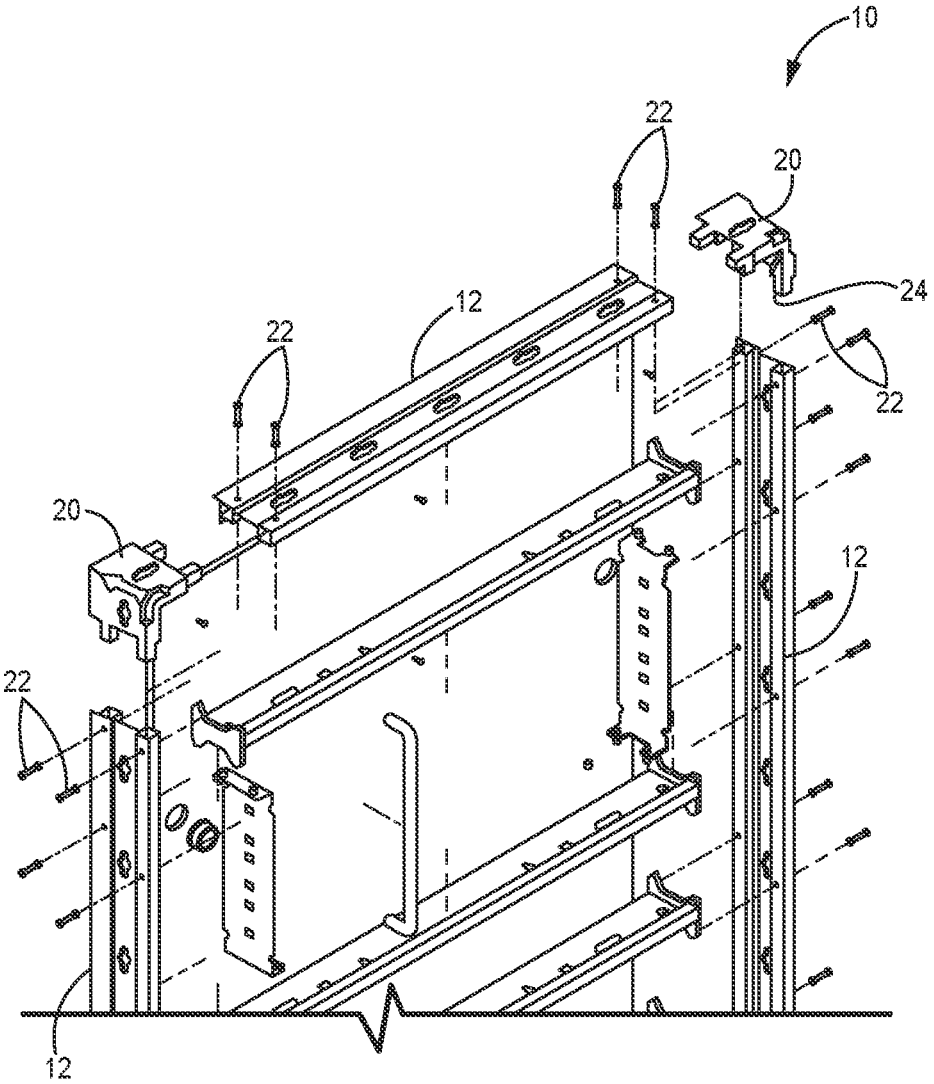
FIG. 1 is an expanded view of a formwork panel, according to one implementation.

Described herein are various devices, systems, and methods of use thereof for joining structural components of various materials together. Particularly described herein are devices providing a corner element for use in formwork and particularly for joining perimeter rails as well as joining panels together.

While many known framed formwork designs utilize a cast corner element, these prior designs do not provide for making a connection through the cast corner element. Further, these prior known designs do not provide for use of a cast corner element for aiding in panel alignment or tilt-up.

Additionally, the prior cast corner designs cannot be preloaded and thereby allow for movement of components prior to being loaded. Various implementations described herein, utilize direct tension lockbolts to assemble the frame, which can match or improve on the speed and consistency found in the assembly of welded frames when significant amounts of labor and manufacturing automation are used to assembly welded frames.

As described above, with many prior known formwork assemblies corner elements are used as transitions at the corner of a panel and are welded to the side rails and as such must be of the same material as the rail elements/remainder of the frame. Additionally, these prior known welded assemblies may not be disassembled to allow for replacement of damaged components.

Certain assembled panels may include a large number of fasteners (150+), the various implementations described herein utilize a smaller number of fasteners (<80) and as such present a cost savings in terms of material as well as labor required for assembly.

The various implementations described herein provide for a corner element that allows for use of dissimilar materials which provides for each component of the assembly to be designed with the material that is most effective for its design requirements and is the most cost effective. Prior known frames cannot use such a variety of structural material due to the need to be made from a single material type for welding/assembly. Use of the corner element and formwork system disclosed herein allows the structure to be designed with variable materials wherein the design of each component can be tailored to fit the weight, cost, structural, or manufacturing capabilities required. This approach allows for a significant savings in weight over structures comprised fully of steel or a significant savings in material cost over a structure comprised fully of aluminum as is for known formwork assemblies of similar capability.

The disclosed corner element and formwork system allows the form panel to be constructed of components that may be replaced or changed when damaged or at the end of their service life. That is parts may be replaced individually (corner element, side rail, face sheet, etc.) as needed, as opposed to needing to replace and entire panel when only one element is at issue. As each component of the panel can be replaced, the owner may extend the service life of the structure indefinitely by replacing components as needed. Additionally, the disclosed devices and methods allow for assembly outside of a centralized manufacturing facility, making it possible to assemble the product where needed, improving freight density.

Further still, the disclosed formwork panels and methods of assembly provide consistent strength and panel geometry as opposed to welded frames. Known welded frames require significant investment in automation to match the speed of assembly of the disclosed panel and are more susceptible to distortions in geometry stemming from the placement of parts and heat applied from welding. To provide adequate fit between panels, additional labor may be necessary to inspect and remove offending areas such as weld spatter.

Additionally, the disclosed corner element is configured to connect multiple panels via the corner element and provide a partial moment connection that allows the user to align and pick-up larger stacks of formwork without the addition of equipment and a minimal number of connectors. Further, the disclosed corner element is configured to provide alignment and partial moment capacity for panels erected end to end as well as side to side.

Turning to the figures in more detail, various implementations of the formwork utilize a corner element 20 that is secured to one or more side panels 12, such as an aluminum extrusion side panel 12 with a fastener 22, such as a lockbolt 22, shown for example in FIG. 1. The corner element 20 may optionally be die cast or formed in any other appropriate manner recognized by those of skill in the art.

Figure 2A:
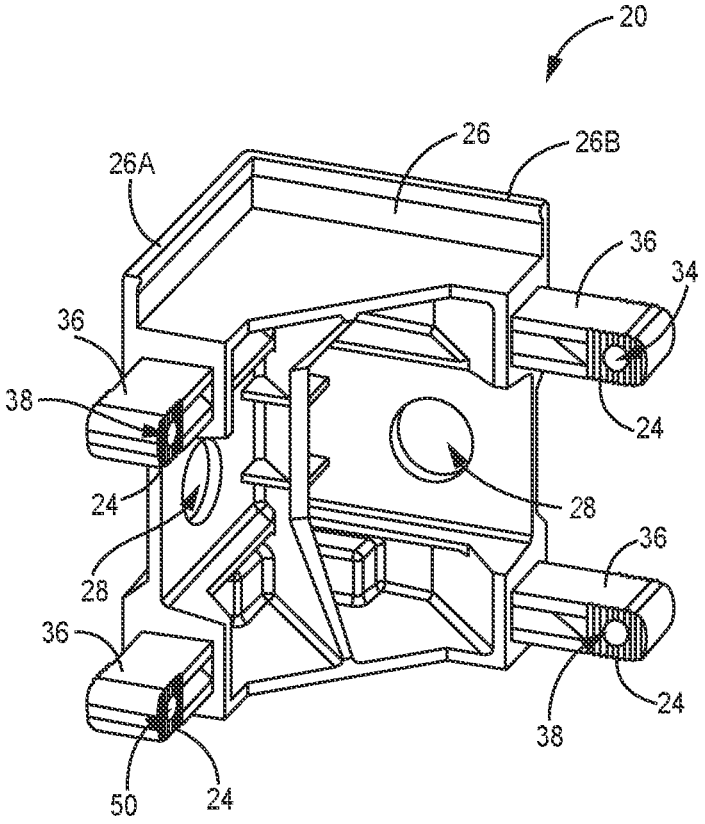
FIG. 2A is an inside, perspective view of a corner element, according to one implementation.
Figure 2B:
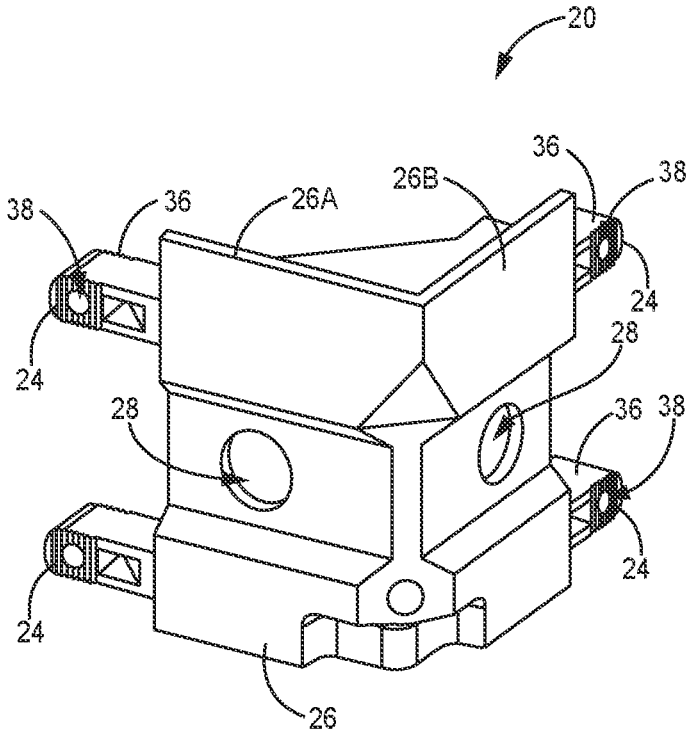
FIG. 2B is an outside, perspective view of a corner element, according to one implementation.

In various implementations, the corner element 20 includes a body 26 forming a generally 90° angle between the first portion 26A and second portion 26B of the body, as seen in FIGS. 2A-2B. The body 26 may also include one or more openings 28 within the body 26. These openings 28 may be configured to attach adjacent corner elements 20 to each other, as will be described further herein. In various implementations, one opening 28 is located on each portion of the body 26A, 26B. The size and shape of the openings 28 may vary, and optionally may be the same size/shape/style as various other openings within the panel 12/formwork system 10.

Figure 2C:
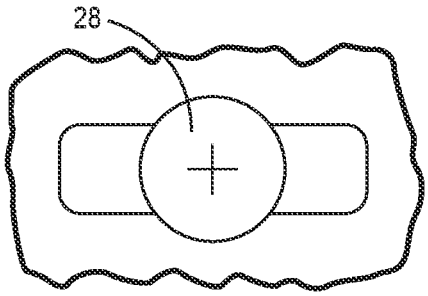
FIG. 2C is an enlarged view of a keyhole of a corner element, according to one implementation.

In various implementations, the openings 28 may be of a keyhole style geometry as shown for example in FIG. 2C. In certain of these keyhole implementations, the opening 28 may have an about 13/16" center thru hole and about 1.7" wide wings designed for a T-shaped connector to pass through the opening 28. Of course various alternative sizes and shapes are possible and contemplated herein. Various alternative implementations may include a circular opening 28, an oval opening 28, or any other style of opening 28 that would be appreciated by those of skill in the art. In certain implementations, the openings 28 are about 1½" openings.

Figure 3A:
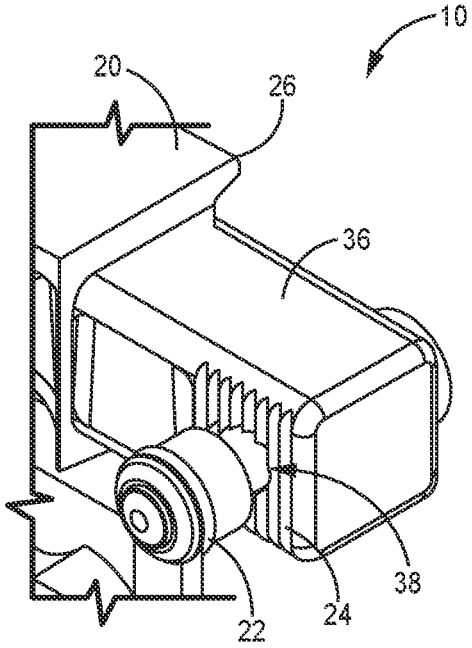
FIG. 3A is a close-up view of a lockbolt and prong of a corner element, according to one implementation.
Figure 3B:
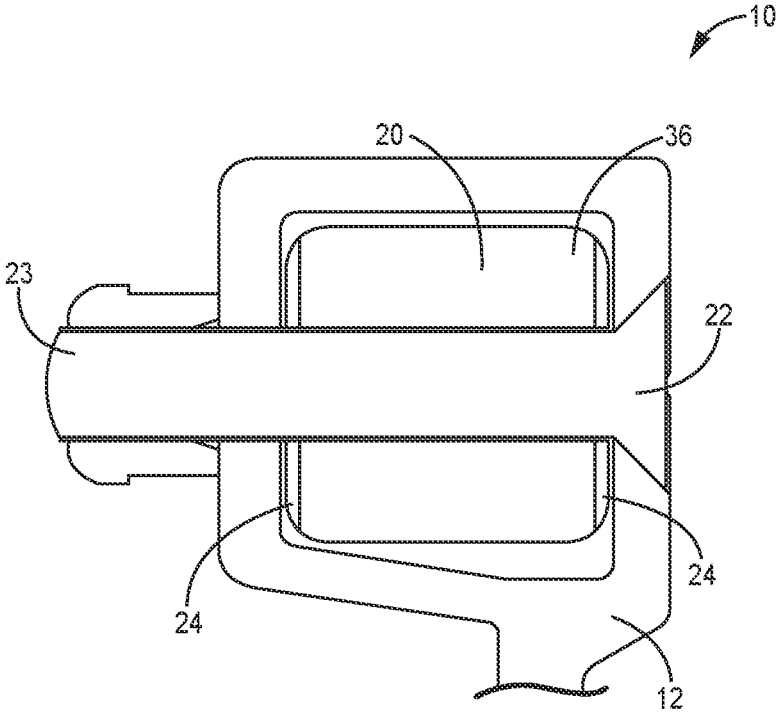
FIG. 3B is a cross-sectional view of a lockbolt and prong of a corner element, according to one implementation.

Continuing to FIGS. 3A-3B, in certain implementations, the corner element 20 includes one or more prongs 36 extending from the body 26. In one specific implementation the corner element 20 includes four prongs 36, two extending from each of the first portion 26A and second portion 26B. In these and other implementations, the size, spacing, and number of prongs 36 correspond to openings/slots within the side panels 12 with which are they intended to engage. Various alternative configurations and numbers of prongs are possible and would be appreciated by those of skill in the art.

In further implementations, the faces of the prongs 36 include locking grooves 24 or serrations. Additionally, the prongs 36 may also include openings 38 for insertion of a fastener 22. As discussed herein, a fastener 22 may be inserted into the openings 38 (FIGS. 3A-3B) and through corresponding opening on the side rails 12, when the side rails 12 are fitted unto the corner element 20. In certain implementations, the fastener 22 is configured to force the side rails 12 into contact with the prongs 36 and locking grooves 24, such that movement between the side rails and corner element 20 is limited, as will be described further herein.

In various implementations, the corner element 20 is configured to have a ¾" opening 28 about 2" off the panel 14 joint 15, such that a threaded lifting eye bolt can be used or an accessory could be bolted across a joint 15 with 4" spacing if desired. In these and other implementations, the openings 28 are detailed in each direction on the corner element 20 but only usable in one direction at any given time due to interference of the fasteners 22 with one another. In these implementations, the openings 28 allow for aligning the stacked panels without a waler and further a single bolt or pin at the bottom of the stack, where no bolt is required vertically, could be used if vertical alignment of the stack is required.

In various implementations, the cast corner element 20 is made from a zinc alloy, while the side panels 12 are aluminum, and the lockbolts 22 are steel. Various alternative materials are possible such as aluminum castings for the corner element 20, plastic extrusions for the side rails 12, and aluminum lockbolts 22 or various alternative materials as would be known and appreciated by those of skill in the art.

Figure 3C:
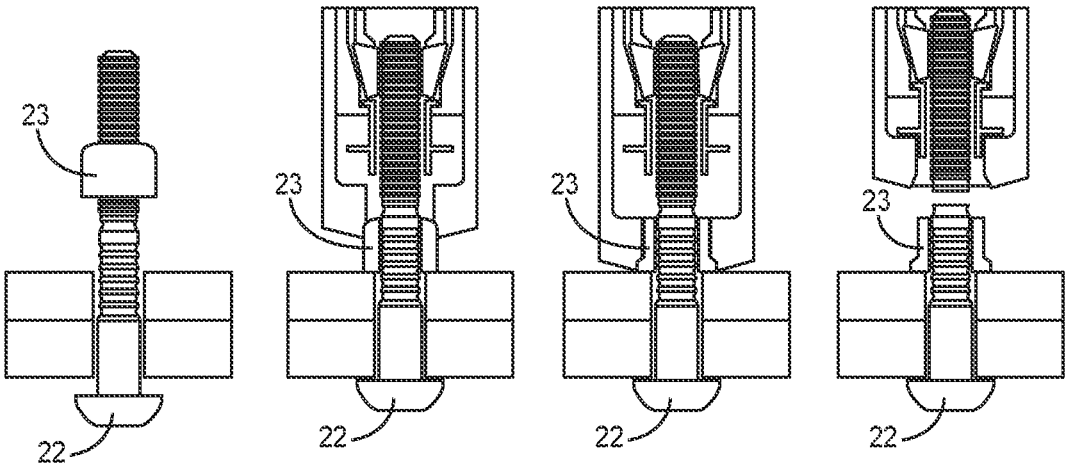
FIG. 3C shows operation of a pin and collar of a lockbolt, according to one implementation.
Figure 4:
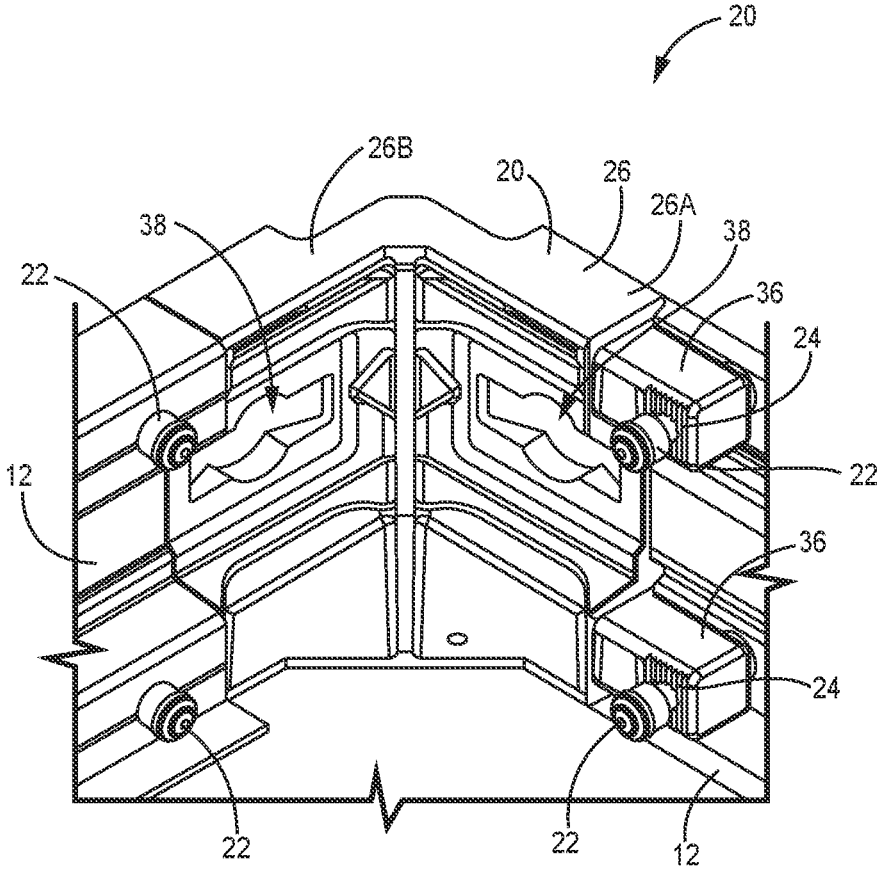
FIG. 4 shows an inside, perspective view of a corner assembly joined with side panels, according to one implementation.

Continuing with FIGS. 3A-4, in various implementations, a direct tension lockbolt 22 is used to secure one element to another, such as the corner element 20 and side rail 12. As would be understood, lockbolts 22 differ from other fastener types including traditional bolts in that they are not turned to fasten nor provide preload in the joint but are instead directly tensioned by the installation process where the collar element is swaged onto the pin, creating a permanent, vibration proof connection. As noted above, this use of lockbolts 22 reduces/prevent rotation and movement of the elements during installation of the fastener 22, as occurs with traditional bolt/screws.

As would be understood by those of skill in the art, a lockbolt 22 includes two parts—the pin 22 and the collar 23 (shown for example in FIGS. 3B-C). The pin 22 includes a head and a shaft like a traditional bolt. The collar 23 is like a traditional nut but is not internally threaded and instead is swaged. The collar 23 being swaged allows for locking the collar 23 in place on the pin 22 by the tooling, as would be understood. As would be further understood, any extended length of the shaft of the pin 22 may be removed during installation of the lockbolt 22. A diagram showing use of a lockbolt 22 is provided in FIG. 3C. The tension developed in the pin 22 must be carried by the parts that are being assembled together, generating large compressive stresses on the bearing faces of the pin 22 and collar 23.

The use of a lockbolt 22 generates tensile stresses on the lockbolt 22 and compressive stresses on the material in the grip of the fastener 22, here the side panel 12. These compressive stresses cause intended deformation of the softer side panel 12 material into the locking grooves 24 designed in the die cast corner element 20, shown in FIG. 4. Other implementations may utilize alternative fasteners 22, such as bolts or screws, with nuts that require prevailing torque to install the fastener. The use of a lockbolt 22 provides larger preload in the fastener and is not capable of loosening unlike other implementations described. Further, installation of direct tension lockbolts 22 is significantly faster, more consistent, and does not require specialized labor or inspection as opposed to installation of traditional fasteners, such as bolts.

The locking grooves 24 reduce movement of the corner element 20 relative to the rail 12 by transferring shear directly to the rail component, improving stiffness of the connection and lessening deflections. That is, in certain implementations, utilizing the preload generated by installation of the lockbolt 22, the softer side panel 12 deforms into the harder corner element 20 material, mechanically locking the two parts together much in the same manner as the lockbolt 22 and its collar 23. This locking action reduces movement of the pieces perpendicular to the direction of the grooves 24 cut in the corner element 20.

Turning to FIGS. 5A-6C, in further implementations, the cast formwork corner is also configured to provide a partial moment connection between panels that may involve bolts or another fastening device installed into the cast corner element 20. In these and other implementations, a formwork panel may be configured with a rail element 12 connected to a cast corner 20 and then to another rail 12 where the cast corner element 20 provides a partial moment connection from one panel to another.

The assembly described herein allows for the formwork panels to be connected at the corner, providing panel pick-up and alignment with the addition of just two connecting parts. The connecting parts themselves fit within the envelop of the form panel and provide less obstruction for a user to work around. Further, because there are no obstructions, panels may be laid upon one another when staging, rather than one panel bearing on compensation walers.

Figure 5A:
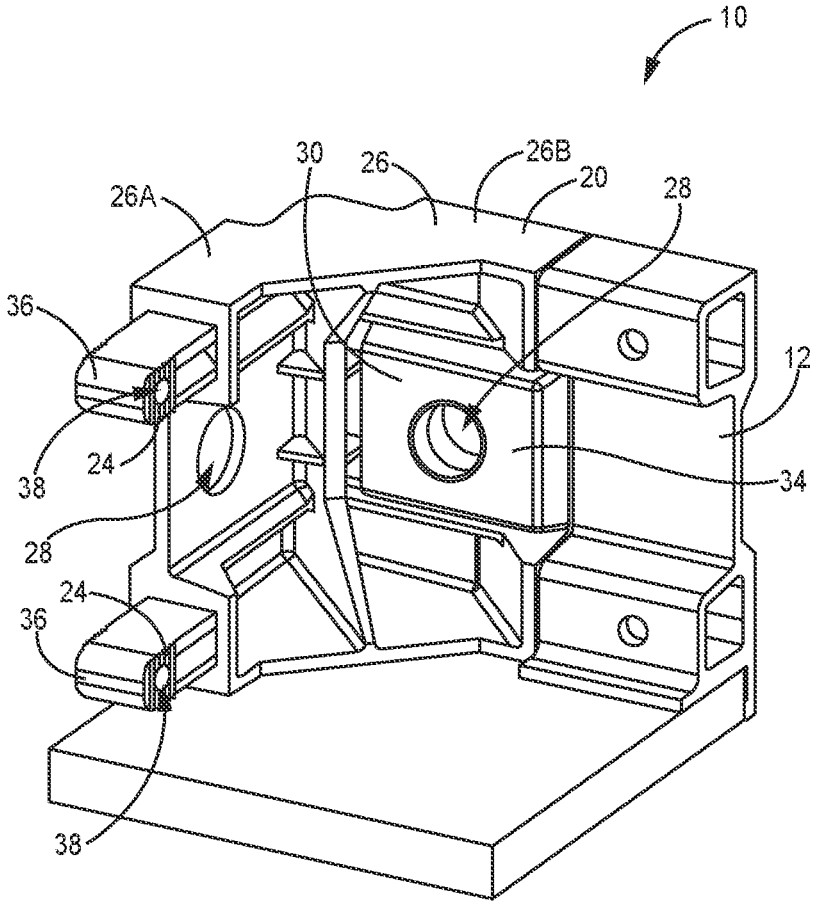
FIG. 5A is an inside, perspective view of a corner element with corner connector, according to one implementation.
Figure 5B:
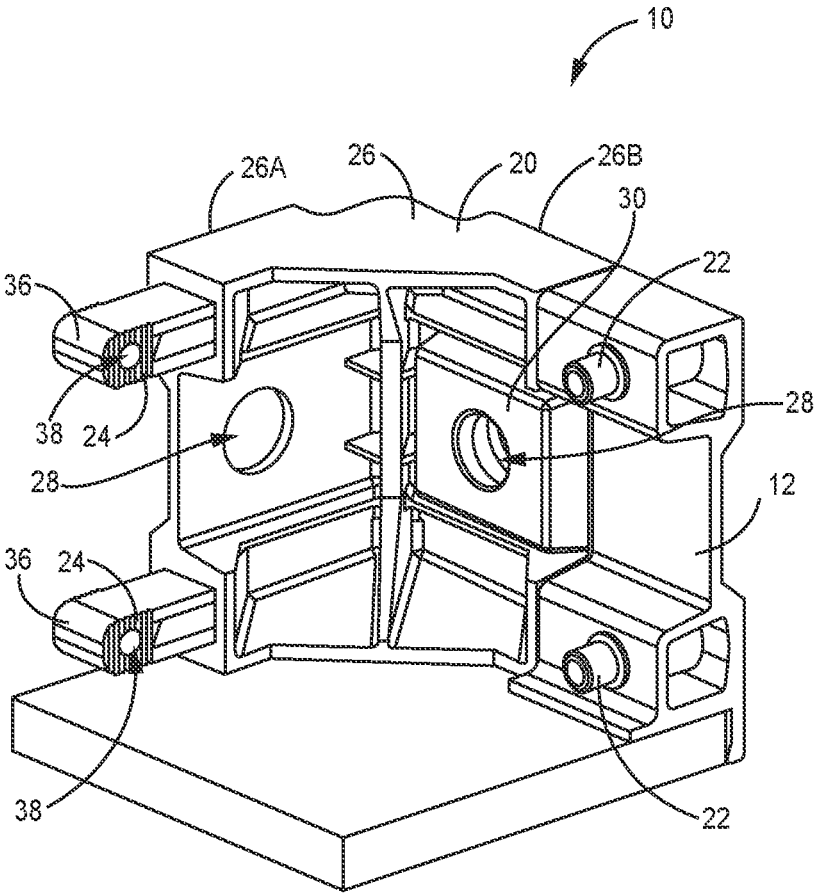
FIG. 5B is an inside, perspective view of a corner element with corner connector and lockbolts, according to one implementation.
Figure 6A:
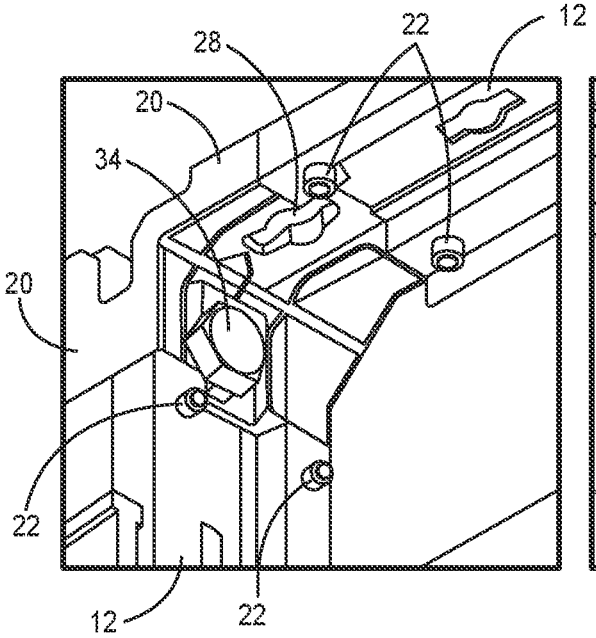
FIG. 6A is an inside, perspective view of a panel corner, according to one implementation.
Figure 6B:
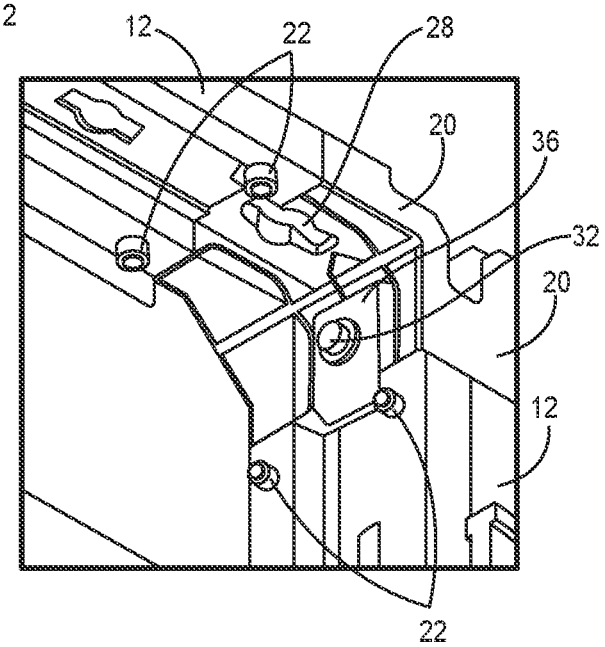
FIG. 6B is an inside, perspective view of a panel corner, according to one implementation.
Figure 6C:
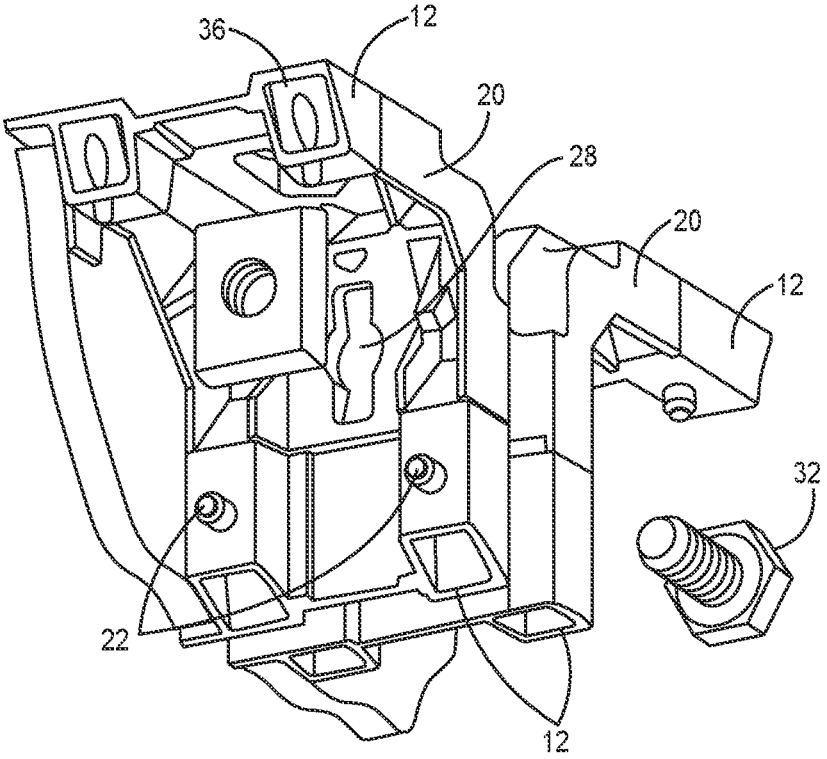
FIG. 6C is a perspective view of two panels connected, according to one implementation.

In certain implementations, the corner elements 20 may be implemented with a bolted connection 30 for connecting corner elements 20 together, as shown in FIGS. 5A-B, while other fastening mechanisms and devices are possible in addition to or alternate from the bolted connection. In these and other implementations, a corner connector 30 is provided whereby a bolt 32 may be threaded through the corner connector to fasten two corner elements 20 together, as shown in FIGS. 6A-C. This, bolted corner connector 30 allows bolt 32 preload to be applied to the joint, holding faces of the corner elements 20 in contact and allowing bolt 32 preload to be generated which prevents opening of the joint until the preload capacity is overcome.

In certain further implementations, the corner element 20 is configured prevent the nut member 34 of the bolted connection 30 from turning due to the square geometry of the nut member 34. This allows the bolt 32 to be installed with a wrench on the bolt side of the joint only, providing a significant advantage over traditionally bolted joints.

Figure 7:
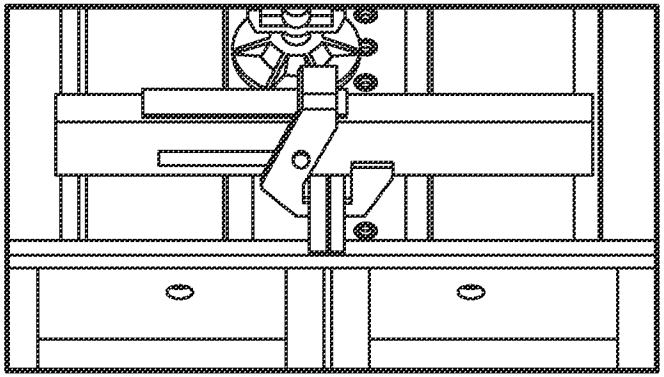
FIG. 7 shows vertically oriented wailings in use on a prior known panel, according to one implementation.

As would be appreciated, vertically oriented wailings, such as that shown in FIG. 7, are often used when stacking formwork panels. Use of the disclosed corner element 20 and bolted connection 30 may allow for user to not need vertically oriented wailings. For example, the RMD Minima system (and others) has aligning walers/clamps that span to the first rib of the panel in each way from the joint to align the panels and carry moment when picking the panel stack up. As would be understood these wailings are bulky and often unique elements serving only this purpose. The disclose corner system eliminates the needs for these wailings because the panels can be stacked directly.

Figure 8:
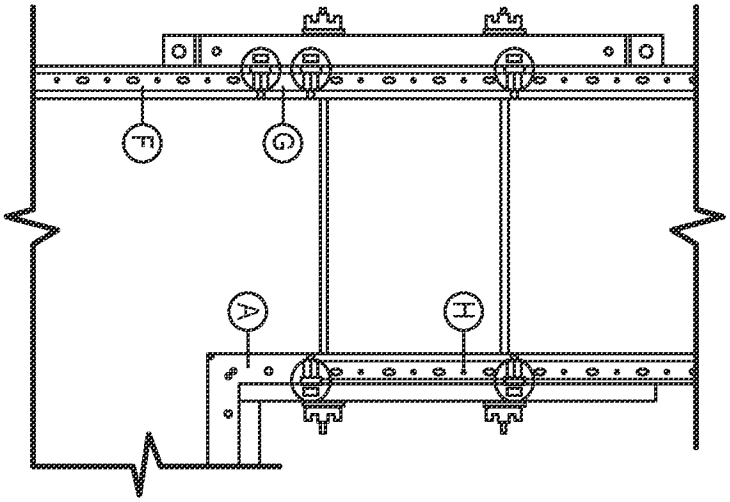
FIG. 8 shows horizontally oriented wailings in use on a prior known panel, according to one implementation.

Horizontally oriented wailings are typically used when spanning or cantilevering across fillers, as would be understood and shown for example in FIG. 8. In various implementations, these horizontal wailings may be eliminated in many instances by having a variable width filler panel and therefore every panel joint being the same. In certain design layouts horizontal wailings may still be desired or necessary.

Figure 9:
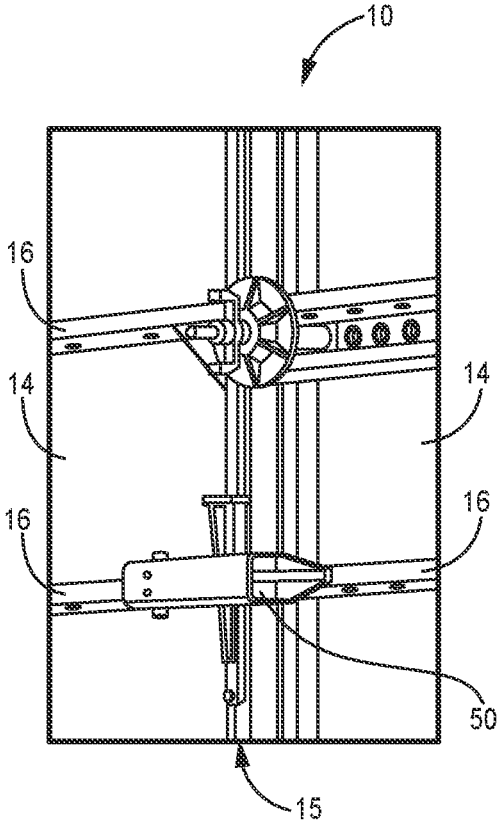
FIG. 9 is a perspective view of a panel with a clamp at a panel joint, according to one implementation.

In various implementations, the system 10 may include a clamp 50 at a panel 14 joint 15, as shown in FIG. 9. As would be appreciated the clap 50 carries some continuity across the panel 14 at the most stiff points on the panel 14, such as at a rib 16 location, in order to maintain a straight wall. Various clamps 50 are known and appreciated in the art.

Figure 10:
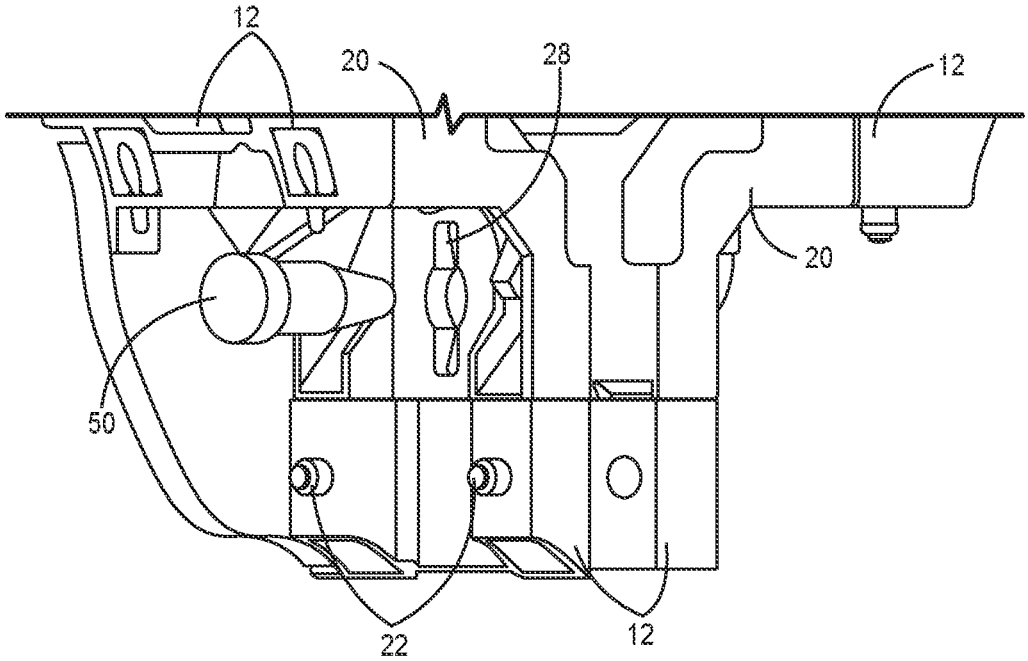
FIG. 10 is a perspective view of panels for vertical alignment, according to one implementation.

In various implementations, if vertical panel alignment is desired, such as the case in a core, an aligning pin 50 may be inserted to provide shear alignment of the panels vertically from one another, shown in FIG. 10.

Figure 11:
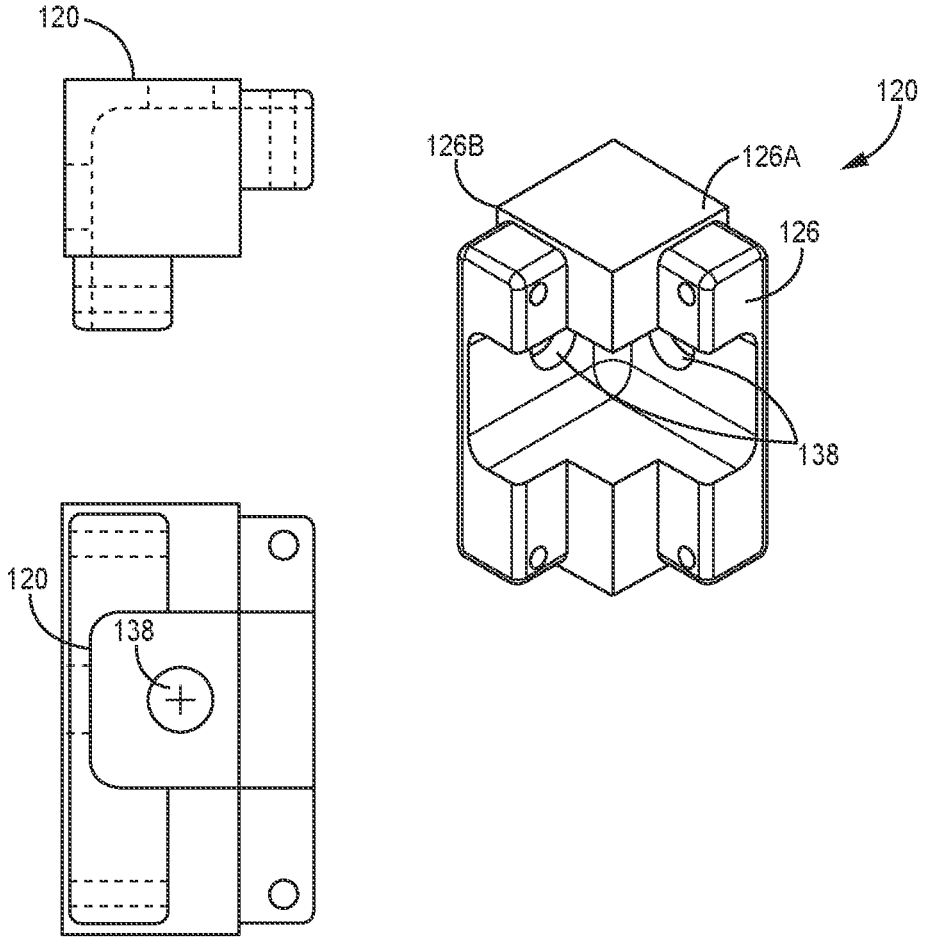
FIG. 11 is a perspective view of a corner element, according to one implementation.

FIG. 11 shows an additional implementation of the corner element 120. In these implementations, the corner element 120 includes a body 126 forming a generally 90° angle between a first portion 126A and second portion 126B of the body 126. The body also include one or more openings 128 configured to attached adjacent corner elements 120 to each other, as discussed above. The openings 128 being similar to the openings 28 of FIGS. 1-9 above. The corner element 120 may also include additional openings 138 configured for insertion of a fastener, such as a lockbolt, for affixing side panels to the corner element 120, in a manner similar to that discussed above.

Although the disclosure has been described with references to various embodiments, persons skilled in the art will recognize that changes may be made in form and detail without departing from the spirit and scope of this disclosure.

What is claimed is:

1. A formwork connector comprising:

(a) a body comprising a first portion and a second portion forming a 90° angle, wherein the body is comprised on a first material;

(b) a first opening in the first portion of the body configured for attaching the formwork connector to another formwork connector to provide a partial moment connection between adjacent formwork panels;

(c) a first prong extending from the first portion configured to engage a side rail comprised of a second material, wherein the first prong comprises one or more faces comprising a plurality of locking grooves; and (d) a first prong opening disposed through the first prong and a first fastener configured to be inserted into the first prong opening, wherein the first fastener is configured to generate a preload causes compressive stress on the side rail such that the second material deforms into the locking grooves of the first prong.

2. The formwork connector of claim 1, wherein the first fastener is a lockbolt.

3. The formwork connector of claim 2, wherein the first fastener is configured to compress the side rail about the first prong upon installation of the lockbolt.

4. The formwork connector of claim 1, further comprising a second prong extending from the first portion, the second prong comprising one or more faces comprising a plurality of locking grooves, and a second fastener configured to be inserted into a second prong opening to compress the side rail about the second prong.

5. The formwork connector of claim 1, wherein the first material of the body is comprised of zinc alloy and the second material of the side rail is comprises of aluminum.

6. A formwork panel system comprising:

(a) a first panel;

(b) a first side rail and a second side rail connected to the first panel, the first side fail and the second side fail each comprised of a first material; and (c) a corner connector connecting the first side rail to the second side rail, the corner connector comprising:

(i) a body comprising a first portion and a second portion forming a 90° angle, the body comprised of a second material;

(ii) at least one opening in the first portion configured to connect the corner connection to a corner connector of a second panel adjacent to the first panel;

(iii) a first prong extending from the first portion, the first prong comprising one or more faces comprising a plurality of locking grooves; and (iv) a second prong extending from the second portion, the second prong comprising one or more faces comprising a plurality of locking grooves, wherein the first side rail is engaged with the first prong and the second side rail is engaged with the second prong via lockbolts, and wherein installation of the lockbolts generates preload that causes deformation of the first material of the first and second side rails into the respective plurality of locking grooves of the first and second prongs.

7. The formwork panel system of claim 6, wherein the lockbolts are configured to compress the first and second side rail about the first and second prong, respectively.

8. The formwork panel system of claim 6, further comprises a rectangular nut member configured to accept a bolt inserted through the at least one opening.

9. The formwork panel system of claim 6, wherein the first material is aluminum, the second material is zinc alloy, and the lockbolts are comprised of steel.

10. A formwork panel system comprising:

(a) a first panel;

(b) a plurality of side rails disposed about the first panel, the side rails comprised of a first material; and (c) a plurality of corner connectors, comprised of a second material, connecting the plurality of side rails into a closed shape, each corner connector comprising:

(i) a body comprising a first portion and a second portion forming a 90° angle;

(ii) at least one opening in the first portion configured to connection the corner connector to a corner connection of a second panel;

(iii) a first prong extending from the first portion, the first prong comprising one or more faces comprising a plurality of locking grooves; and (iv) a second prong extending from the second portion, the second prong comprising one or more faces comprising a plurality of locking grooves, wherein the plurality of corner connectors and plurality of side rails form a rigid body secured to the first panel, and wherein lockbolts secure the plurality of side rails to the first and second prongs, the lockbolts generating preload the causes deformation of the first material of the side rails into the locking grooves of the prongs mechanically interlocking the corner connectors and the side rails.

11. The formwork system of claim 10, wherein the at least one opening secures the panel to a second panel having a corner connector via a bolt and rectangular nut member.

12. The formwork connector of claim 10, wherein the lockbolt is a direct tension lockbolt.

13. The formwork panel system of claim 10, wherein the first material is aluminum, the second material is a zinc alloy, and the lockbolts are comprised of steel.

14. The formwork panel system of claim 10, wherein panels are configured to be stacked without the use of wailings.

15. The formwork panel system of claim 10, wherein the second material of the plurality of side rails is a material other than zinc alloy.

16. The formwork connector of claim 5, wherein the first fastener is a lockbolt comprised of steel.

* * * * *